US006045677A

United States Patent [19]

Beetz, Jr. et al.

[11] Patent Number: 6,045,677

[45] Date of Patent: Apr. 4, 2000

[54] MICROPOROUS MICROCHANNEL PLATES AND METHOD OF MANUFACTURING SAME

[75] Inventors: Charles P. Beetz, Jr., New Milford; Robert W. Boerstler, Woodbury, both of Conn.; John Steinbeck, Fitzwilliam, N.H.; David R. Winn, Wilton, Conn.

[73] Assignee: NanoSciences Corporation, Oxford, Conn.

[21] Appl. No.: 08/807,469

[22] Filed: Feb. 27, 1997

Related U.S. Application Data

[60] Provisional application No. 60/012,389, Feb. 28, 1996.

[51] Int. Cl.[7] ..... H01J 43/04; C25D 11/02

[52] U.S. Cl. ..... 205/50; 205/83; 205/122; 205/157; 205/199; 205/201; 205/210; 205/213; 205/219; 205/223; 250/214 VT; 313/103 CM

[58] Field of Search ..... 205/118, 122, 205/157, 199, 200, 201, 209, 210, 212, 213, 223, 50, 83; 250/214 VT; 313/103 CM, 105 CM

[56] References Cited

U.S. PATENT DOCUMENTS

| | | | |
|---|---|---|---|
| 3,626,233 | 12/1971 | Wainer et al. | 313/105 |
| 3,922,651 | 11/1975 | Imamura et al. | 365/57 |
| 4,052,710 | 10/1977 | Calhoun et al. | 365/3 |
| 4,290,843 | 9/1981 | Korenstein et al. | 216/22 |
| 4,360,899 | 11/1982 | Dimyan et al. | 365/171 |
| 4,468,757 | 8/1984 | Rosenblum | 365/12 |
| 4,629,486 | 12/1986 | Uchiyama et al. | 65/429 |
| 4,780,395 | 10/1988 | Saito et al. | 430/315 |
| 4,853,020 | 8/1989 | Sink | 65/393 |
| 4,913,750 | 4/1990 | Kakuno et al. | 148/304 |
| 4,950,939 | 8/1990 | Tosswill | 313/103 CM |
| 5,075,247 | 12/1991 | Matthews | 438/3 |
| 5,086,248 | 2/1992 | Horton et al. | 313/103 CM |
| 5,132,586 | 7/1992 | Boulais et al. | 313/105 CM |
| 5,205,902 | 4/1993 | Horton et al. | 216/56 |
| 5,262,021 | 11/1993 | Lehmann et al. | 205/655 |
| 5,265,327 | 11/1993 | Faris et al. | 29/825 |
| 5,378,960 | 1/1995 | Tasker et al. | 313/103 CM |
| 5,471,363 | 11/1995 | Mihara | 361/305 |
| 5,493,169 | 2/1996 | Pierle et al. | 313/103 CM |
| 5,544,772 | 8/1996 | Soave et al. | 216/2 |
| 5,568,013 | 10/1996 | Then et al. | 313/532 |
| 5,569,355 | 10/1996 | Then et al. | 438/20 |
| 5,670,949 | 9/1997 | Kirby et al. | 340/632 |

OTHER PUBLICATIONS

Walter Hübner et al. The Practical Anodizing of Aluminum, MacDonald and Evans, London, pp. 7–11 and 21–23, 1960.

G.W. Fraser, "The Soft X–Ray Quantum Detection Efficiency of Microchannel Plates," *Nuc. Inst. Meth.,* vol. 195 (1982)*Month of publication not available, pp. 523–538.

J.L. Wiza, "Microchannel Plate Detectors," *Nuc. Inst. Meth.,* vol. 162 (1979)*Month of publication not available, pp. 587–601.

S. Matsuura, S. Umebayashi, C. Okuyama and K. Oba, "Characteristics of Newly Developed MCP and Its Assembly," *IEEE Trans. Nuc. Sci.,* vol. NS–32, No. 1 (1985)*Month of publication not available, pp. 350–354.

M. Ito, H. Kume and K. Oba, "Computer Analysis of the Timing Properties in Micro Channel Plate Photomultiplier Tubes," *IEEE Trans. Nuc. Sci.,* vol. NS–31, No. 1 (1984)*No month available, pp. 408–412.

(List continued on next page.)

*Primary Examiner*—Kathryn Gorgos
*Assistant Examiner*—William T. Leader
*Attorney, Agent, or Firm*—Lerner, David, Littenberg, Krumholz & Menlik, LLP

[57] ABSTRACT

A microchannel plate and method of manufacturing same is provided. The microchannel plate includes a plate consisting of an anodized material and a plurality of channels which are formed during the anodization of the material and extend between the two sides of the plate. Electrodes are also disposed on each side of the plate for generating an electrical field within the channels. Preferably, the material is alumina and the channels are activated such that the channel walls are conductive and highly secondary emissive.

16 Claims, 5 Drawing Sheets

OTHER PUBLICATIONS

K. Oba and P. Rehak, "Studies of High–Gain Micro–Channel Plate Photomultipliers," *IEE Trans. Nuc. Sci,* vol. NS–28, No. 1 (1981)*No month available, pp. 683–688.

H. Kume, S. Suzuki and K. Oba, "Recent Development of Photomultiplier Tubes for Nuclear and Medical Applications," *IEEE Trans. Nuc. Sci.,* vol. NS–32, No. 1 (1985)*No month available, pp. 355–359.

D. Washington et al., "Technology of Channel Plate Manufacture", *ACTA Electronica,* vol. 14 (1971)*No month available, p. 201.

J.D. Mackenzie, "Mico Channel Plate Glass Analysis Studies," Final Technical Report, Department of Materials Sciences, UCLA (1977)*No month available.

W.C. Wiley and C.F Hendee, "Electron Multipliers Utilizing Continuous Strip Surfaces," *IEEE Trans. Nuc. Sci.,* vol. NS–9 (1969)*No month available, pp. 103–106.

B.R. Sandel, A.L. Broadfoot and D.E. Shemansky, "Microchannel Plate Life Tests," *Appl. Optics,* vol. 16, No. 5 (1977)*No month available, pp. 1435–1437.

F.D.G. Bennett and D.G. Thorpe, "Gain Degradation of Lead–Type Channel Electron Multipliers in Ultra–High Vacuum," *J. Phys. Ed.,* vol. 3 (1969)*No month available, pp. 241–143.

H.J.L. Trap, "Electric Conductivity in Oxide Glasses", *ACTA Electronica,* vol. 14 (1971)*No month available, p. 41.

A. Authinarayanan and R.W. Dudding, "Changes in Secondary Electron Yield From Reduced Lead Glasses," *Advances in Electronics and Electron Physics,* vol. 40A (1976)*No month available, p. 167–181.

G.W. Fraser, The Electron Detection Efficiency of Microchannel Plates, *Nuc. Inst. Meth.,* vol. 206 (1983)*No month available, pp. 445–449.

S. Matsuura, S. Umebayashi, C. Okuyama and K. Oba, "Current Status of the Micro Channel Plate," *IEEE Trans. Nuc.Sci.,* vol. NS–31 (1984)*No month available, pp. 399–403.

G.W. Fraser, M.A. Barstow and J.F. Pearson, "Imaging Microchannel Plate Detectors for X–Ray and XUV Astronomy," *Nuc. Inst. Meth.,* vol. A273 (1988)*No month available, pp. 667–672.

M.B. Williams, S.E. Sobottka and J.A. Shepherd, "Evaluation of an Imaging Phototube Using Microchannel Plates With Delay Line Readout," *IEEE Trans. Nuc. Sci.,* vol. 38, No. 2 (1991)*No month available, pp. 148–153.

C.A. Foss, Jr. G.L. Hornyak, J.A. Stockert and C.R. Martin, "Optical Properties of Composite Membranes Containing Arrays of Nanoscopic Gold Cylinders," *J. Phys. Chem,* vol. 96 (1992)*No month available, pp. 7497–7499.

M. Saito, S. Nakamura and M. Miyagi, "Light Scattering by Liquid Crystals in Columnar Micropores," *J. Applied Physics,* vol. 75, No. 9 (1994)*No month available, pp. 4744–4746.

A. Despic and V.P. Parkhutik, "Electrochemistry of Aluminum in Aqueous Solutions and Physics of Its Anodic Oxide," *Modern Aspects of Electrochemistry,* No. 20, Chap. 6 (1989)*No month available, pp. 401–503.

C.R. Martin, "Nanomaterials: A Membrane–Based Synthetic Approach," *Science,* vol. 266 (1994)*No month available, pp. 1961–1966.

S. Nakuramura, M. Saito, L. Huang, M. Miyagi and K. Wada, "Infrared Optical Constants of Anodic Alumina Films with Micropore Arrays," *Jpn. J. Appl. Phys.,* vol. 31 (1992)*No month available, pp. 3589–3593.

M.A. Barstow, J.E. Lees and G.W. Fraser, "Observation of Microchannel Plate Multifibre Structure in Soft X–Ray Images," *Nuc. Inst. Meth.,* vol. A286 (1990)*No month available, pp. 350–354.

J.G. Timothy, "Electronic Readout Systems for Microchannel Plates," *IEEE Trans. Nuc. Sci.,* vol. NS–32, No. 1 (1985)*No month available, pp. 427–432.

H. Bruining, "Secondary Electron Emission From Metal Compounds; Review of Results," *Physics and Applications of Secondary Electron Emission* (1954)*No month available, Chap. 4, pp. 52–68.

K.G. McKay, "Secondary Electron Emission," *Advances in Electronics,* vol. 1 (1948)*No month available, pp. 65–129.

O. Hachenberg and W. Brauer, "Secondary Electron Emission From Solids," *Advances in Electronics and Electron Physics,* vol. 11 (1959)*No month available, pp. 413–499.

H. Seiler, "Secondary Electron Emission in the Scanning Electron Microscope," *J. Appl. Phys.,* vol. 54, No. 11 (1983)*No month available, pp. R1–R18.

B.N. Laprade and S.T. Reinhart, "Recent Advances in Small Pore Microchannel Plate Technology," *Soc. Photo. Instr. Eng.,* vol. 1072 (1989)*No month available, pp. 119–129.

R.J. Tonucci, B.L. Justus, A.J. Campillo and C.E. Ford, "Nanochannel Array Glass," *Science,* vol. 258 (1992)*No month available, pp. 783–785.

G.W. Fraser, J.F. Pearson and J.E. Lees, Evaluation of Long Life ($L^2$) Microchannel Plates for X–Ray Photon Counting, *IEEE Trans. Nuc. Sci.,* vol. 35, No. 1 (1988)*No month available,, pp. 529–533.

F. Keller, M.S. Hunter and D.L. Robinson, "Structural Feature of Oxide Coatings on Aluminum," *J. Electrochem. Soc.,* vol. 100 (1953)*No month available, pp. 411–419.

O.H.W. Siegmund, J. Vallerga and B. Wargelin, "Background Events in Microchannel Plates," *IEEE Trans. Nuc. Sci.,* vol. 35, No. 1 (1988)*No month available, pp. 524–528.

C. D'Ambrosio, T, Gys, H. Leutz, D. Piedigrossi and D. Puertolas, "First Beam Exposures of a Scintillating Fiber Tracker Readout by an ISPA–Tube," CERN–PPE/94–152, CERN–LAA/SF/94–31 (1994)*No month available.

L.M. Terman, D.P. Spampinato and C.H. Sie, "Nondestructive Readout Memory Cell," IBM Tecnical Disclosure Bulletin, vol. 8, No. 11 (1996)*No month available, pp. 1598–1599.

H.J. Kump and N.C. Logue, "Coupled NDRO Magnetic Film Memory," IBM Technical Disclosure Bulletin, vol. 13, No. 7 (1970)*No month available, pp. 2110–2111.

D. Al–Mawlawi, C.Z. Liu and M. Moskovits, "Nanowires Formed in Anodic Oxide Nanotemplates," *J. Mat. Res.,* vol. 9, No. 4 (1984)*No month available, pp. 1014–1018.

N. Tsuya, T. Tokushima, M. Shiraki, Y. Wakui, Y. Saito, H. Nakamura, S. Hayano, A. Furugori and M. Tanaka, "Alumite Disc Using Anordic Oxidation," *IEEE Trans. Mag.,* vol. MAG–22, No. 5 (1986)*No month available, pp. 1140.–1145.

MICROPOROUS MICROCHANNEL PLATES AND METHOD OF MANUFACTURING SAME

This appln claims the benefit of U.S. Provisional No. 60/012,389 filed Feb. 28, 1996.

STATEMENT OF GOVERNMENT INTEREST

This invention was made with Government support under Contract No. DE-FG02-95ER82036 awarded by the Department of Energy. The Government has certain rights in this invention.

BACKGROUND OF THE INVENTION

Microchannel plates (MCP) have long been used in a variety of different applications. As shown in FIG. 1 from J.Wiza, "Microchannel Plate Detectors", Nucl. Instr. Methods 162, 587 (1979),and as their name suggests, an MCP 10 is a plate of material with extremely thin holes or channels 12 running from one side of the plate to the other. The actual channels formed in the MCP can be seen in photos taken from scanning electron microscopes. For example, FIG. 2 is an electron micrograph of the top plan view of a typical MCP and is taken from M.A. Barstow et al., NIM A286 350 (1990).

The walls of the channels are coated with a secondary emitter, which means that whenever an electron collides with the channel's walls, at least one other electron is produced in response to the collision. Each channel of an MCP is generally cylindrical and has a diameter and length. The ratio of diameter to length is known as the channel's aspect ratio, and is represented by the following formula:

$$\alpha=L/d, \tag{1}$$

where L is the length of the channel (the thickness of the plate) and d is the diameter. The actual sizes of the channels can depend on the material used to form the MCP. For example, channels in glass-based MCP's are typically 10–15 $\mu$m in diameter, but can range anywhere from about 5 $\mu$m to 100 $\mu$m in diameter. The aspect ratio a of glass-based MCP's is typically between 40 and 100.

In normal commercial applications, the plate is made of a material which functions as both a secondary emitter and an insulator (i.e. it prevents electrons from flowing through the material). For example, matrix 15 may consist of lead glass which has been changed by reduction in hydrogen to form a secondary emitter surface consisting of Pb/PbO. In some instances, the glass is covered by a tin layer of $SiO_2$ to further improve secondary electron yield. The lead glass matrix may be formed by repeatedly drawing a preform of etchable glass fibers clad with the lead glass until the fiber core shrinks to the desired diameter. The glass is then sawed into discs of the appropriate thickness and the cores etched away. The resultant disc is then heated in a reducing atmosphere to produce a Pb-rich, weakly conducting surface. A thin layer (20–200 nm) of $SiO_2$ is then deposited over this surface to provide a surface with a high secondary yield. Finally, the top and bottoms of the disc are coated with metallic electrodes 17 and 18.

In operation, a high voltage is applied from electrode 17 to electrode 18, i.e. between the front and back surfaces of the MCP (the resistance of the matrix is typically $10^9\Omega$). As shown in FIG. 3, which is a schematic of a MCP, the electric field created by the electrodes accelerates the electrons 23 through the channel and the electrons collide with the channel's walls 21. Whenever an electron collides with a wall, at least one other electron is produced in response and accelerated through the channel. These new electrons also collide with the channel walls and produce even more electrons. The process continues so that the successive secondary emission creates a cascade of electrons exiting the channel. Each channel acts as a continuous dynode. Thus, an MCP consists of an array of parallel and miniature channels which function as electron multipliers.

The average number of electrons emitted for each collision may be approximated by a formula. Specifically, the secondary emission yield of electrons emitted per incident electron is:

$$\delta=AV_c^{1/2}, \tag{2}$$

where A is a proportionality constant and $V_c$ is the electron collision energy in eV. For a wide range of lead glasses used in MCP activation, A is about 0.2 and $\delta_{max}$ is about 3.5 at 0.3 kV.

An MCP has many different applications, but its main commercial use is for imaging amplification applications such as night vision goggles and the like. FIG. 4 schematically represents a gated MCP photomultiplier tube offered by Hamamatsu Corp for high rate applications. In operation, photons of light 42 bounce off of the object 40 to be viewed and are projected onto photocathode 44 of the tube 46. Wherever a photon hits photocathode 44, an electron 45 is generated from the material and travels under the presence of an electrical field from the photocathode and into the channels of MCP 48. Due to the secondary emission described above, the number of electrons exiting a channel will be greater than the number of electrons entering the channel. Thus, MCP 48 amplifies the photoelectron pattern of the optical image 40 being projected onto photocathode 44. The resulting amplified electron image exiting the MCP is then projected onto silicon target anode 49. The photocathode 44, MCP 48 and anode target 49 are disposed within housing 47 and kept in a vacuum. In a manner well known in the art, the anode converts the amplified electron image into a pixelated image which may be viewed on a computer-controlled display. Alternatively, the electrons may be projected through an electron lens and then directly onto a phosphor screen, which causes the phosphor to glow and form an amplified image of object 40.

MCP's are used in applications other than night vision. For electron amplification, charged particle and energetic photon detection (mainly UV or soft x-rays), an MCP has the virtues of high speed (sub-ns rise/fall times, transit time spreads less than 100 ps), high gain (typically about $10^3$–$10^6$/MCP stage), two-dimensional incident electron image preservation under amplification, immunity to magnetic fields, and compactness. Thus, an MCP may also be used in: the fastest rise time and lowest time-jitter photomultiplier tubes; for charged particle and photon detection in a wide variety of physical science instrumentation; in streak cameras; as amplifiers for cathode ray tube beams; and, potentially, in many other vacuum electronics devices as a gain mechanism.

Despite the broad applications for MCP's, typical MCP's suffer from a number of disadvantages inherent in their manufacture. Specifically, the availability and efficiency of using an MCP in a particular application will depend upon the limitations of gain and gain degradation with accumulated charge.

The gain of a channel represents the number of electrons generated by a channel in response to electrons entering the channel. Thus, the greater the gain, the better the amplification of the image being viewed. The gain of a channel is given by:

$$G=(AV/2\alpha V_0^{1/2})\gamma \quad (3)$$

where $$\gamma=4\alpha^2(V_0/V) \quad (4)$$

and V is the total channel voltage and $V_0$ is the initial energy of the secondary electron about (1 eV). Gains for lead glass-based channels are normally between $10^3$ and $10^4$ at V=1000 V, depending on the activation processing (i.e., the creation of a secondary emitter surface in the channel). As the voltage applied across the MCP increases, the number of collisions within the channel walls decreases and the secondary emission will be less orthogonal to the walls. Accordingly, the gain saturates with increasing voltage. The maximum aspect ratio and gain are given by:

$$\alpha M=AV/(3.3V_0^{1/2}) \quad (5)$$

and $$1n\ G_M=0.184A^2V. \quad (6)$$

For typical MCP channels using activated Pb-glass, the gain $G_M$ is about 1500 at V=1 kV with the aspect ratio $\alpha_M$ at about 60. When the aspect ratio increases beyond $\alpha_M$ (for example, the plate thickness increases while the hole diameter remains constant), the gain saturates at the maximum gain value. In other words, the maximum gain of a channel will depend on a number of factors, including keeping a set proportion between the diameter and length of the channel. In straight-channel glass MCP, the gain limit is typically between $10^3$ and $10^5$.

Another major problem for the MCP gain mechanism using reduced lead glass channels or other activation methods on glass is the decrease in gain with total charge drawn from the channel. Put simply, the MCP's tend to wear out over time especially if the MCP's are not stored in a vacuum or are exposed to high temperatures. Such high temperatures can occur if the plate's material becomes hot from ohmic heating when a voltage is applied to the electrodes. The change in gain with use is a major impediment to more widespread use of MCP, and is a major challenge for MCP manufacturers.

Degradation of gain with operation is almost unavoidable with the chemistry of silica-based glasses because of the evolution of and reaction with impurities in the channel by the electron bombardment of the channel surface. The problem is especially acute with newer, higher yield lead glass channels. The problem of gain degradation with increased use can be understood in terms of a simple surface ionization process during secondary emission that results in the removal of the secondary emitter through reaction with a finite population of poisoning species such as adsorbed gasses or glass impurities. This explanation can describe gain degradation over a wide range of cumulative area charge drawn from the channel. To the applicant's knowledge, the best gain as a function of Q (cumulative charge density) is a reported 50% gain reduction after 0.1 to 0.01 C/cm$^2$ is drawn from the MCP and is typically closer to the lower value. The newer glass channels with the half-gain at the 0.1 C/cm$^2$ level suffer from a dark noise which is 5 times that of the "standard" MCP. Typical gain degradations to the half-value correspond to an exposure of about $10^{14}$ electrons/cm$^2$ incident at a gain of 1,000. Typical gain reduction with accumulated charge has been discussed by A. Authinarayanan and R. Dudding, Aadv. Electron. Physics 40A, 167 (1976). Gain reductions with accumulated charge limit the length of operation and the precision of measurements made with these detectors.

In summary, prior art MCP's suffer from a number of disadvantages. They are relatively expensive, being consistently near or above \$100/cm$^2$. They are only available in limited dimensions: While MCP's are commonly a few centimeters in diameter, they are generally not available in sizes greater than 11 cm×11 cm. Moreover, because it is difficult for prior art MCP's to have extremely small channel diameters and because the resolution of an amplified image is proportional to the density of the channels, prior art MCP's cannot be both miniature and have relatively very high resolutions. Prior art MCP's also suffer from steady gain degradation. In addition, prior art MCP's have spatial non-uniformities in gain, that is the gain changes from one channel to the next across the plate. Typical measurements show that the difference in gain between channels varies by about a factor of two and that there is about a 30% change in FWHM of the gain distribution across a 4 cm diameter MCP when a uniform input is applied to all channels.

Accordingly, there is a need for a lower-cost MCP which overcomes the foregoing disadvantages. Many applications would benefit from such an MCP, including imaging photodetectors and intensifiers, energetic particle calorimetry in nuclear or medium energy physics, fusion reaction products, particle imaging, medical imaging, or energetic particle track imaging using scintillating fibers.

SUMMARY OF THE INVENTION

The present invention addresses these needs.

The present invention relates to the field of microchannel plate manufacture and use. Accordingly, the present invention also relates to applications using such technology, such as but not limited to imaging apparatus, night vision, photo multiplier tubes, charged particle and photon detection, streak cameras, and cathode ray tube and beam amplifiers.

One preferred embodiment of the present invention provides a microchannel plate which includes a plate and electrodes. The plate is made of an anodized material having first and second sides. A plurality of channels are formed in the plate during the anodization of the material. First and second electrodes are disposed adjacent the first and second sides, respectively, and generate an electrical field within the channels. The material may result from the electrochemical anodization of a metal such as aluminum, silicon, copper, beryllium, magnesium, yttrium, titanium, zirconium, vanadium, niobium, or tantalum substrate materials. Preferably, the anodized material is alumina.

The channels may be generally cylindrical and perpendicular to the two sides, and defined by walls such that the average closest distance between the walls of two neighboring channels is about 300 Å. Desirably, the diameter of the channels is between about 500 nm to 5 nm, the aspect ratio of the channels is between about 1:1 to 2000:1 and preferably about 60:1, and the number of channels per square-centimeter of the sides is between about $10^7$ and $10^{10}$.

Another preferred embodiment of the present invention is an imaging apparatus which includes a microchannel plate as described as well as a photocathode for generating electrons in a pattern defining an object and an image target for receiving electrons exiting the microchannel and for creating an image of the object. The apparatus may further include a housing defining a chamber at about vacuum, whereby the photocathode, microchannel plate and image target are disposed within the housing. The imaging apparatus is used for amplifying images of dimly lit objects.

Yet another preferred embodiment of the present invention comprises (a) anodizing a plate of material to form channels which extend from a first side of the material to a second side of the material and (b) disposing first and second electrodes adjacent the first and second sides, respectively. Preferably, the step of anodizing includes placing the plate in an electrochemical cell containing an electrolyte. The cell also includes an anode and a cathode disposed within the electrolyte. An electrical potential is applied to the anode. The electrolytes desirably comprise a 0.5 to 20 wt. percent aqueous solution containing phosphoric, sulfuric, oxalic, hydrofluoric, nitric and caustic soda or chromic acid, and preferably a 0.5 wt. percent solution of oxalic acid. The cathode may be lead, graphite, platinum or stainless steel.

It is recommended that the method also include the step of cleaning the plate before the step of anodizing by chemically etching the surface of the plate in a solution to remove excess oxide and dirt, rinsing the plate and vacuum baking the plate. The solution may be about 16:4:1:4 by volume of phosphoric acid, nitric acid, acetic acid and deionized water, respectively. It is further recommended that the plate be electropolished before anodization by placing the plate in an electrochemical cell containing about 4:1 solution of glacial acetic acid to about 60% perchloric acid, a cathode of platinum wire mesh, and an anode with an applied potential of about 1 V for about 5 minutes.

Preferably, the method also includes the step of widening the channels by etching the channels in an about 0.5 to 80 wt percent phosphoric acid solution at a temperature between about 0 and 100° C., such as a solution of about 5 wt. percent phosphoric acid solution at about 37° C. It is recommended that the plate be immersed in water between the step of anodizing and the step of widening.

The method also preferably includes depositing the electrodes by oblique evaporation, attaching the plate to a support frame, attaching the second electrode to the support frame, attaching a lead to the support frame, attaching a lead to the first electrode, and cleaning the plate.

Desirably, the material is activated, whereby the secondary emissivity and conductivity of the walls of the channels are increased. One manner of activating the channels includes depositing a metal ion oxide on the channel walls by Metal-Organic Deposition (MOD), such as by immersing the plate in a dilute solution (e.g. tin(II) chloride) containing the metal ion oxide (e.g. $SnO_2$) in the form of a metal organic precursor compound and extracting, heating and decomposing the metal organic precursor. Another manner of activating the channels includes depositing a metal ion oxide on the channel walls by Chemical Vapor Deposition (CVD). Preferably, the metal oxide is $SnO_2$ and is deposited by vapor pyrolysis of $SnCl_4$ in $H_2O$ vapor at temperatures of 400–1000 C.

Yet another preferred embodiment of the present invention is a microchannel plate manufactured in accordance with the foregoing method.

In a further preferred embodiment, a method is provided for manufacturing a microchannel plate which includes anodizing a plate of aluminum into alumina to form channels which extend from a first side of the material to a second side of the material, the channels having walls defined by the alumina and disposing first and second electrodes adjacent the first and second sides, respectively, whereby by applying a voltage between the first and second electrode to create an electric field within the channels, electrons are accelerated through the channels in the direction of the electrical field, collide with the walls, and cause the secondary emission of additional electrons.

Preferably, the method also includes the steps of anodizing and further comprises anodizing the surface of an aluminum foil; protecting the anodized surface with a photoresist; removing the unanodized portion of the aluminum from the foil using an acid etch; and removing the photoresist. The acid is desirably selected from the group consisting of phosphoric acid, nitric acid, acetic acid and combinations thereof.

In sum, the present invention introduces a new family of nanometer scale structures for channel plate electron multiplier devices which extend the applicability of existing microchannel plate technology. The present invention includes methods for producing a large areal density, cost effective submicron or nanometer-sized channels which enable satisfactory levels of electron gain to be achieved in compact geometries. This method of fabrication offers the possibility of producing large area channel plates which cannot be practically made by conventional MCP fabrication methods. The diameter, depth and surface density of the channels may be readily controlled by the anodization process parameters. For example, potential dimensions include channel diameters from 300 nm to 5 nm, aspect ratios from 1:1 to over 2000:1 and surface density of channels from $10^7$ to over $10^{10}/cm^2$. The higher areal density of MCP channels offers superior spatial resolution of amplified electron images and lower dead time per area of plate over conventional microchannel plates.

DETAILED DESCRIPTION OF THE PREFERRED EMBODIMENTS

Figure 5:
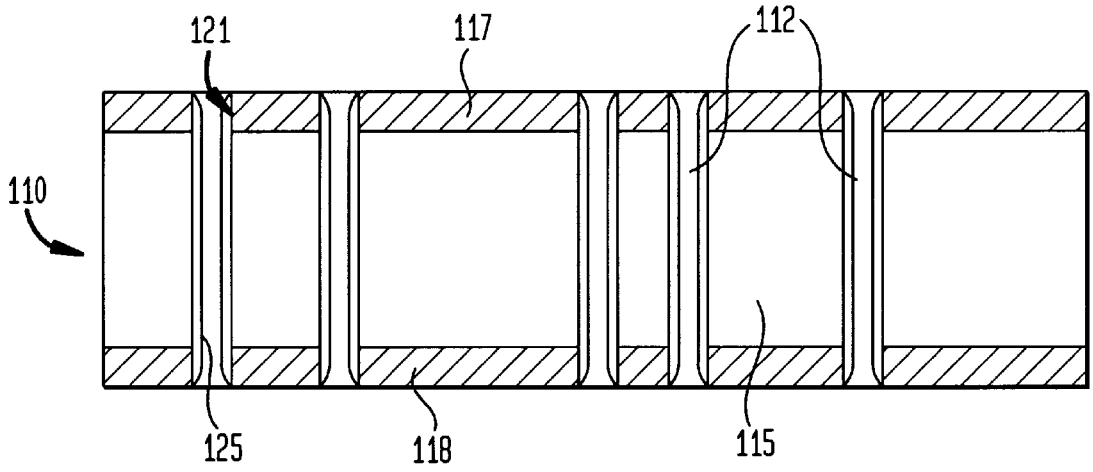
FIG. 5 is a schematic of an MCP in accordance with the present invention.

The present invention provides an MCP comprised of an alumina film which has been anodized to create microchannels for secondary emission. As shown in FIG. 5 , MCP 110 comprises a plurality of channels 112 disposed in a matrix 115 of alumina. Electrodes 117 and 118 are disposed on opposite sides of the MCP.

The fabrication of a nanochannel alumina MCP essentially comprises the following steps: (1) anodization of an aluminum film; (2) deposition of electrodes onto each side of the alumina plates; (3) attachment to a thin support frame; (4) attachment of electrical leads; and (5) final bake out and inspection. One advantage of the present invention is that steps 2–5 are similar to the steps used to package glass MCP's. A sixth step, which may occur at different stages in the process, comprises increasing the conductivity of the channel walls.

1. Anodization

The first step of the process is to anodize a plate of aluminum to create channels which will serve as the electron multiplier channels. The anodization of aluminum in an acid bath is well-known. The resulting oxide film consists of densely packed channels separated by thin walls of alumina as explained in, for example, F. Keller, M. Hunter and D. Robinson, "Structural Feature of Oxide Coating on Aluminum", J. Electrochem. Soc. 100, 411 (1953). The alumina films are produced using solutions of phosphoric, sulfuric, chromic, hydrofluoric, nitric and caustic soda and oxalic acids at concentrations from 0.5% to 20%.

Figure 6:
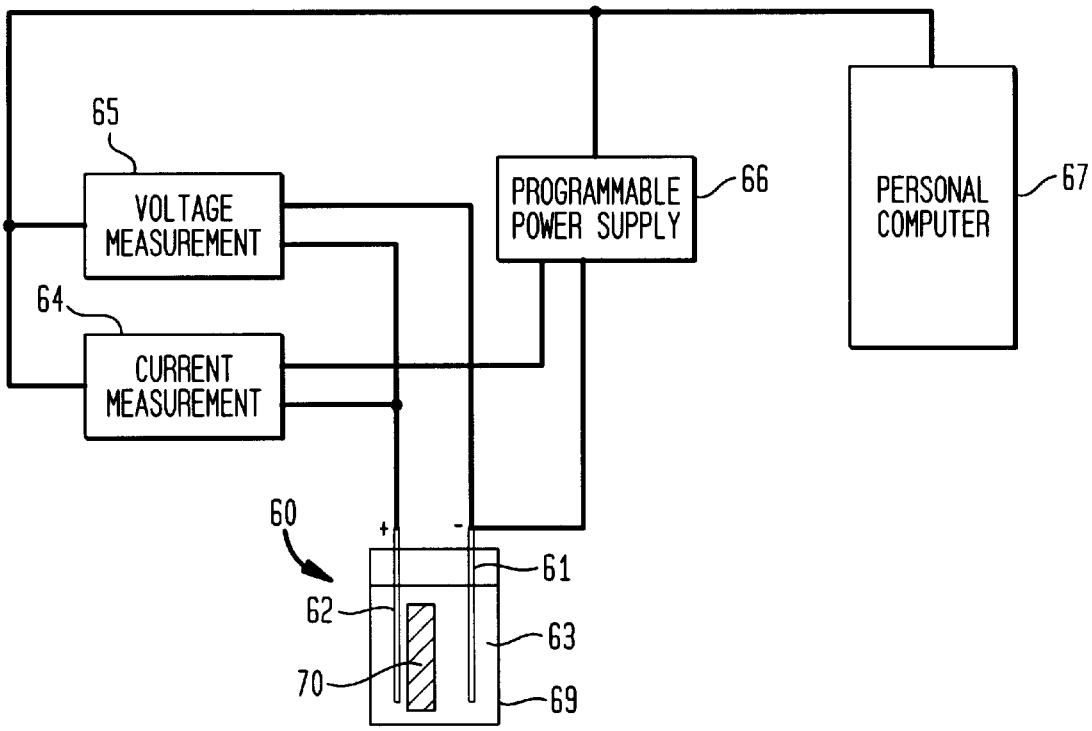
FIG. 6 is a schematic of a system for anodizing an MCP in accordance with the present invention.

The anodization process is carried out in an electrochemical cell as shown in FIG. 6. The cell 60 comprises an electrolyte 63, a cathode 61, the anode work piece 62, a container 69, and a programmable power supply 66 to generate the anodization potential. The electrolyte 63 typically used for aluminum anodization is a 0.5 to 20 wt. percent aqueous solution of phosphoric, sulfuric, oxalic, or chromic acid. The cathode 61 is typically lead, graphite, platinum or stainless steel. The power supply 66, such as a Keithley 228A programmable power supply, supplies a positive electrical potential V to the aluminum anode 62. The potential supplied may be either an ac or dc signal and may for short periods supply a negative bias to the anode. The anodization process is carried out in container 69 which is not reactive with the electrolyte 63.

The preferred method of anodization for the fabrication of alumina MCP devices is to use a 0.5 wt. percent solution of oxalic acid as electrolyte 63 in a glass or plastic container 69. Platinum wire is the preferred cathode 61 material. The process is preferably carried out as a dc process with power supply 66 keeping the aluminum work piece 70 at positive bias voltage V throughout the anodization process. The anodization voltage and current are measured by meters 65 and 64, respectively, and these measurements are used by computer 67 to control and monitor the process.

Prior to carrying out the channel forming anodization process, it is preferable to clean the work piece surface by chemically etching the surface in a phosphoric/nitric/acetic acid solution to remove excess oxide and dirt from the surface. The composition of the solution typically used to carry out the etch is prepared in the ratio of about 16:4:1:4 by volume of phosphoric acid, nitric acid, acetic acid and deionized water, respectively. The etch is followed by thoroughly rinsing in deionized water air drying and vacuum baking at about 100° C. for one hour.

An additional electropolishing step may be used prior to the final cleaning step to improve the surface quality of the starting aluminum material. This step is carried out in an electrochemical cell similar to that in FIG. 6. The electrolyte used to electropolish the aluminum surface is a 4:1 solution of glacial acetic acid to 60% perchloric acid. The cathode is preferably a platinum wire mesh. The power supply is used to hold the aluminum work piece at a potential of 1 V for approximately 5 min. The surface quality resulting from this treatment is generally superior to that of the starting material as evidenced by improved specular reflection of a laser beam. The electropolishing step is preferred when the starting aluminum material is in the form of bulk sheet, bar or block where the surface quality cannot be controlled.

The oxalic acid anodization process creates a layer of alumina which contains nanochannels that are nominally 120 Å in diameter. The diameter of the channels is nearly independent of the anodization voltage. The channel to channel separation, or cell size, C is dependent on the voltage V supplied to the anodization cell. The relationship between C and V is:

$$C\ (nm)=2WV+P(nm) \tag{7}$$

where W is the thickness of the wall between the channels and P is the channel diameter. The oxalic acid anodization process has a W which is typically 1.65 nm/V. The fraction ratio f of the volume of the channels to the volume of the film is:

$$f=0.785P^2/C^2 \tag{8}$$

By combining equations 8 and 9, the channel volume can be determined for the original processing conditions in the anodization cell as:

$$f=0.785[(2W/P)V+1]^{-2}. \tag{9}$$

After the channel forming anodization step, the work piece is rinsed in deionized water.

It is then preferable to increase the diameter of the formed channels from their initial 120 A by using a channel widening etch. The channel widening etch is carried out in a 0.5 to 80 wt percent phosphoric acid solution between 0 and 100° C. The preferred etch is a 5 wt percent phosphoric acid solution at 37° C. as described by D. Al-Mawlawi, C. Z. Liu, and M. Moskovits in the Journal of . Materials Research, 9, 1014 (1994). It is recommended that the work piece remain immersed in water between the anodization and the channel widening etch bath to prevent gas bubbles from forming in the channels which will inhibit the etching of the alumina channel walls. The channel widening etch is used to maximize the front surface open area of the alumina MCP. The preferred time for the channel widening etch for a C is such that the final wall thickness $W_f$ is 300 Å.

Figure 8:
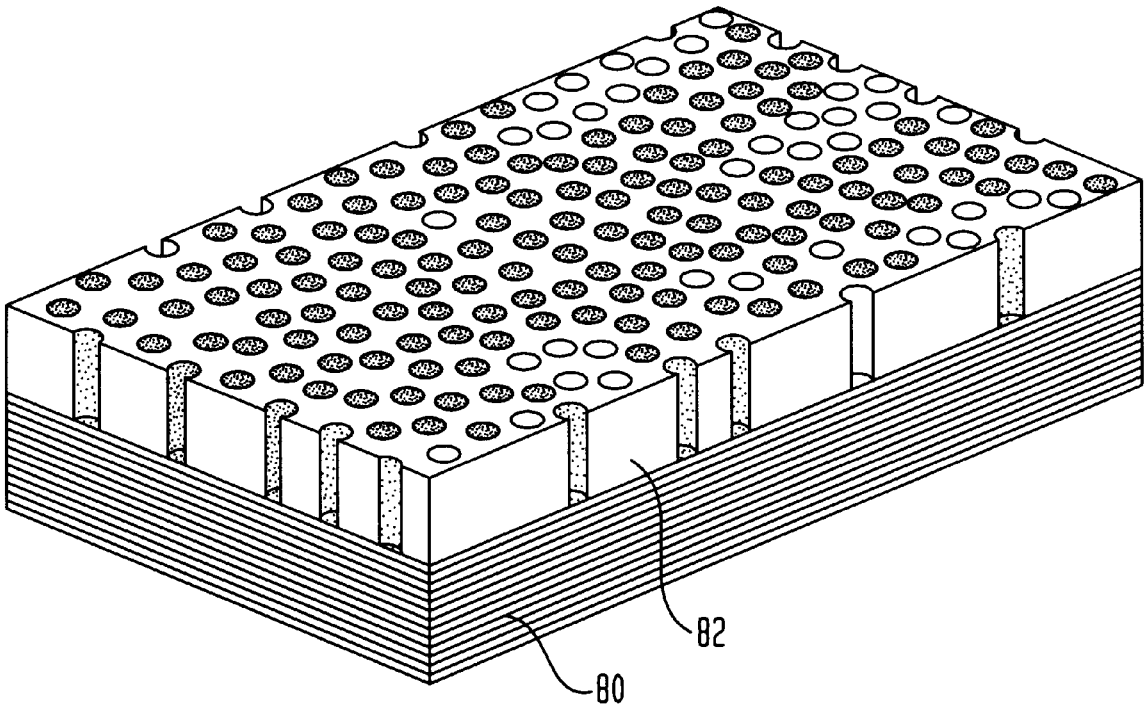
FIG. 8 is a schematic of an alumina film prior to detachment from an aluminum substrate.

The MCP may be fabricated on any form of aluminum or aluminum alloy. The preferable starting material is a pure aluminum foil whose thickness is determined by the final aspect ratio of the channels desired and the width of the channels. After the channel widening step, the surface of the foil which contains the channels is protected using a photoresist. The excess aluminum is then removed from the back of the foil using the same phosphoric/nitric/acetic acid etch used to clean the foil surface prior to anodization. The photoresist is then removed from the MCP using a solvent such as acetone. FIG. 8 illustrates an alumina film 82 still attached to the aluminum substrate 80 before removal of the substrate.

Figure 7:
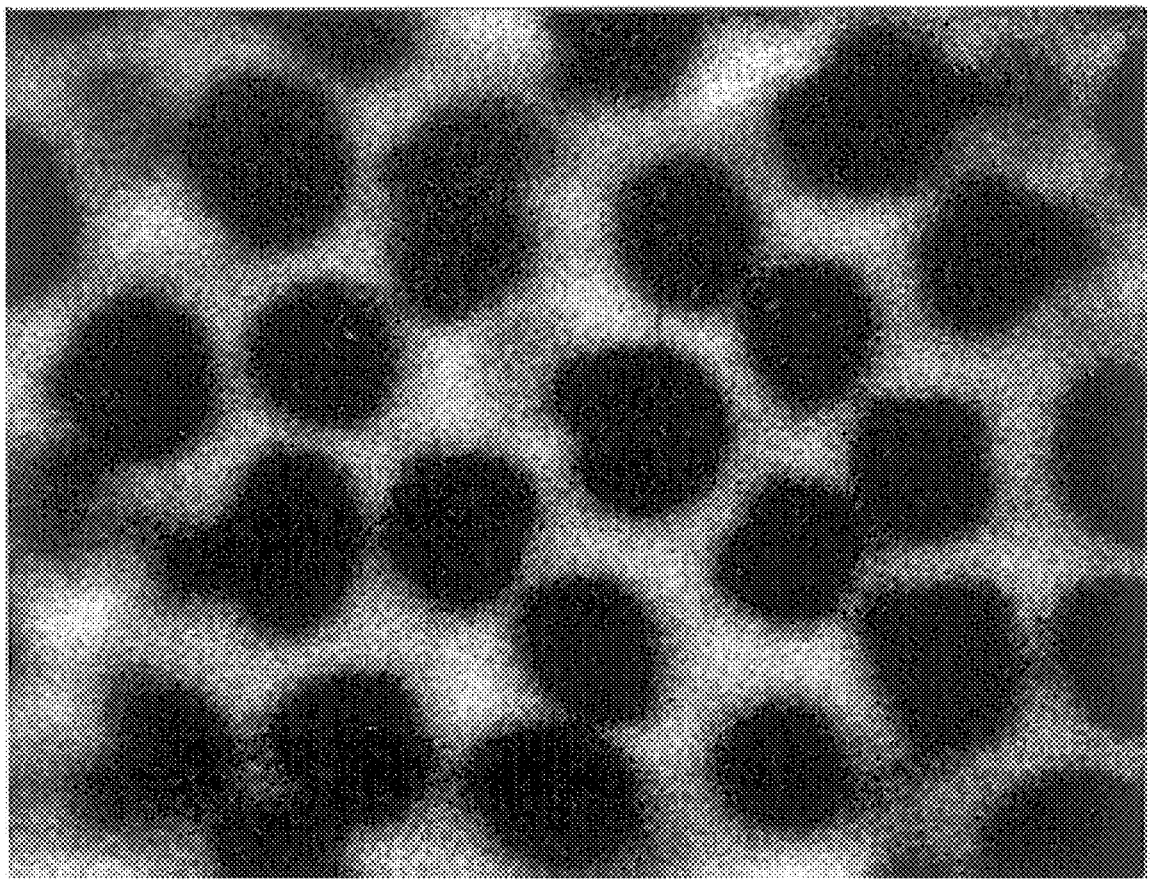
FIG. 7 is a scanning electron microscope photograph of an alumina film in accordance with the present invention.

By anodizing the aluminum as described above, a plate containing channels is created. FIG. 7 shows a plan-view of the array of circular channels in an anodized alumina sheet prepared by the above anodization and channel widening processes. FIG. 7 is an SEM photograph at 50.000× magnification of an alumina film that has been channel widened in 5 wt. % $H_3PO_4$.

Although it is preferable that the matrix material be comprised of alumina, other acceptable materials would include the electrochemical anodization of silicon, copper, beryllium, magnesium, yttrium, titanium, zirconium, vanadium, niobium, and tantalum substrate materials.

2. Deposition of Electrodes

Electrodes 117 and 118 (FIG. 5) are deposited by oblique evaporation in order to prevent blocking the openings of channels 112. Specifically, the alumina film is placed so that the plane of the film is at an angle which is less than 70 degrees to the direction of the impinging flux of metal atoms. Alternatively, the film can be rotated at a constant angular velocity to uniformly coat the surfaces to a thickness of about 10–100 nm. Several metals may be used, including Al, CuBe(2%), AgMg(2%), Ni and the nickel alloy nichrome, which is common for existing MCP electrodes. Plates are examined by SEM to determine if the channels are clear and the metal is smooth and adhering. Resistance measurements across the surface and through the thickness at many points are made in air to determine if the plate is acceptable.

3. Attachment to Thin Support Frame

Once the electrodes are formed, the MCP plate is placed on a support frame. The framework is typically a thin metal or ceramic outer "picture-frame" which serves as a mechanical support for the fine lead wires which form the connections. In the case of a metal support ring, an insulator must be provided to electrically isolate the front and backside support rings. For ceramic supports, the electrical contacts are provided by screen printed or evaporated metal layers on the front and back sides. The framework also serves as a guard or focusing electrode. The bottom electrode is electrically connected to the frame and a lead attached to the frame.

4. Attachment of Electrical Leads

After the support frame is attached, a thin ring with a fine wire is pressed against the top electrode during measurements. Care should be taken so that the lead run geometry minimizes distortion in the electrical field in the MCP, and that the HV lead does not give rise to field emission.

5. Final Bake Out

Post-anodization cleaning procedures and heat treatments are used to remove processing residues and adsorbed species such as water. Anodized films are cleaned with solvent reagents, distilled water, and dried in vacuum, and finally heat treated in inert atmospheres or vacuum at temperatures up to about 1,500° C. (but, preferably, 400° C.) for several hours.

6. Methods for Activating Channel Walls

Although alumina is a secondary emitter and emits electrons in response to being bombarded with other electrons, its performance as an MCP is improved by activating the alumina to increase its conductivity. Accordingly, it is preferable to add an activation step which would provide a means for conducting charge back to the channel walls to neutrtlze the charges resulting as secondary emission occurs, and also to provide a surface which has a higher secondary electron coefficient ($\geqq 2$).

A method for increasing the conductivity and secondary electron coefficient is the deposition of conductive metal oxide coatings 125 on the surface of the channel walls 121 (FIG. 5). Processes for depositing conductive coatings include: Metal-Organic Deposition (MOD) and Chemical Vapor Deposition (CVD).

The metal-organic deposition (MOD) process starts with a dilute solution containing the metal ion oxide in the form of a metal organic precursor compound. An alumina channel plate is immersed into the solution, extracted and heated to decompose the metal organic precursor to leave a metal oxide layer on the surface of the substrate. For example, by using MOD, uniform layers of $SnO_2$ may be produced by decomposing solutions containing tin(II) chloride at temperatures on the order of 450° C. on the surface of alumina channel plates . The thickness of the deposited film can be controlled by diluting the precursor solution. A uniform film less than 1000 Å have been produced. Additional thinning may produce films which are less than 500 Å thick. Thinning the solution not only assists in creating very thin layers, but also ensures the thin layers are confined to the surfaces of the channel walls and do not block the channels.

Another process for depositing a metal oxide on the channel walls is chemical vapor deposition or CVD. The advantages of CVD include uniform layer deposition, high volume production capability, and very good thickness control because it is a vapor based process. The use of an entirely vapor-based process eliminates concerns about solution viscosity. One potential metal-oxide for making the conductive layer while maintaining a surface having a high secondary electron yield is $SnO_2$. As is well known in the art, vapor pyrolosis of $SnCl_4$ in $H_2O$ vapor at temperatures of 400–1000 C. will produce a $SnO_2$ film. While this process does not produce $SnO_2$ with the lowest electrical resistivity, the conductive properties of the layer and the secondary electron emission coefficient ($\delta \sim 2$) are adequate for charge leakage and electron gain in the MCP of the present invention. A similar pyrolytic process may be used to deposit $MnO_2$ from $MnCl_3$, or $Cr_2O_3$ from precursors containing chromium acetyl-acetonate, for example. Other potential metal oxides include $MgIn_20_4$, $InGa0_{31}$, $Zn_2In_2O_5$ and Indium Tin Oxide.

In sum, the total manufacturing process consists of several major steps: anodization of an aluminum film, foil, sheet or bulk preform to form a free-standing microchannel alumina plate; post anodization processing to obtain the desired channel diameter and aspect ratio; channel activation; metallization of both sides by oblique evaporation; mounting in support frame and lead attachment; final heat treatment, and inspection and testing.

7. Characteristics

Figure 1:
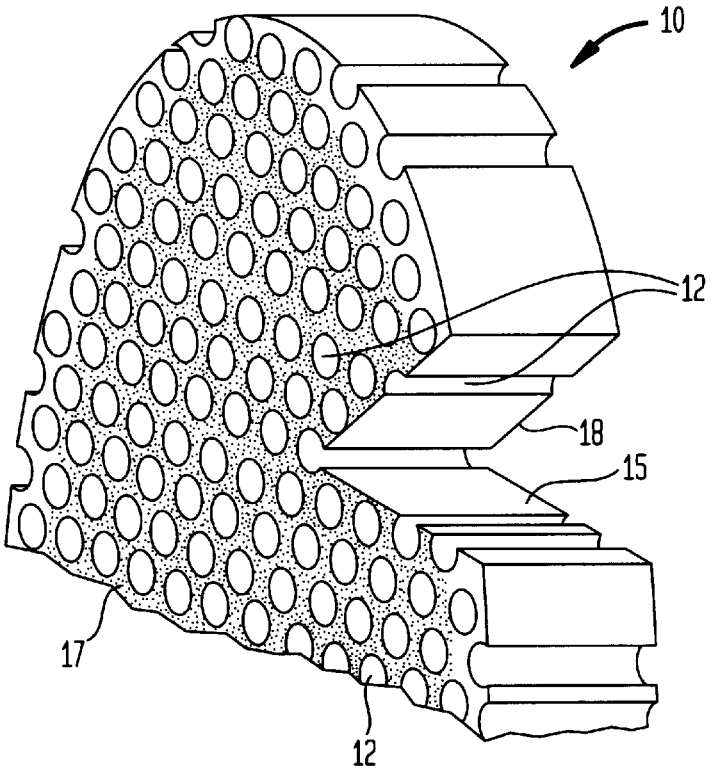
FIG. 1 (PRIOR ART)
FIG. 1 is a schematic of a microchannel plate (MCP).
Figure 2:
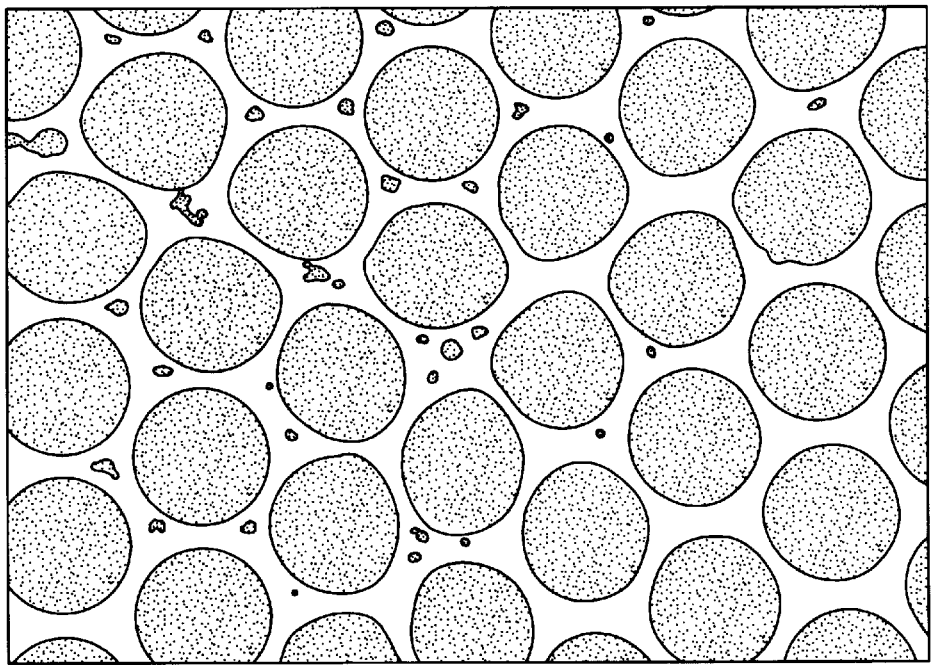
FIG. 2 (PRIOR ART)
FIG. 2 is an electron micrograph of the top plan view of a typical MCP.
Figure 3:
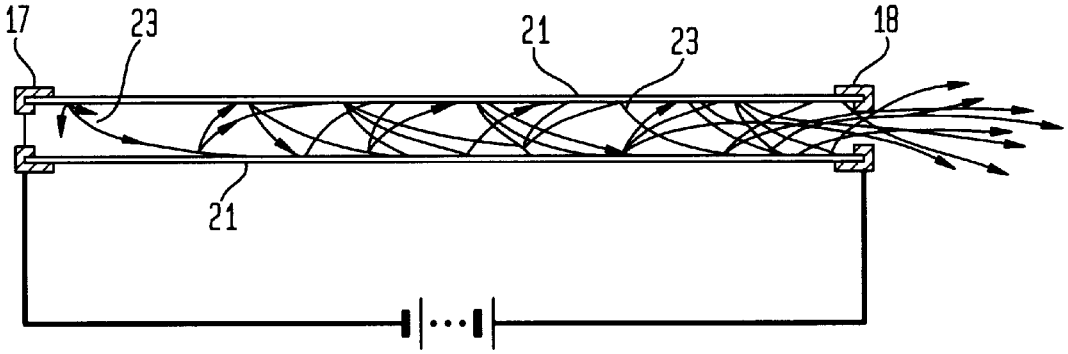
FIG. 3 (PRIOR ART)
FIG. 3 is a schematic of the secondary emission characteristics of a channel of an MCP.
Figure 4:
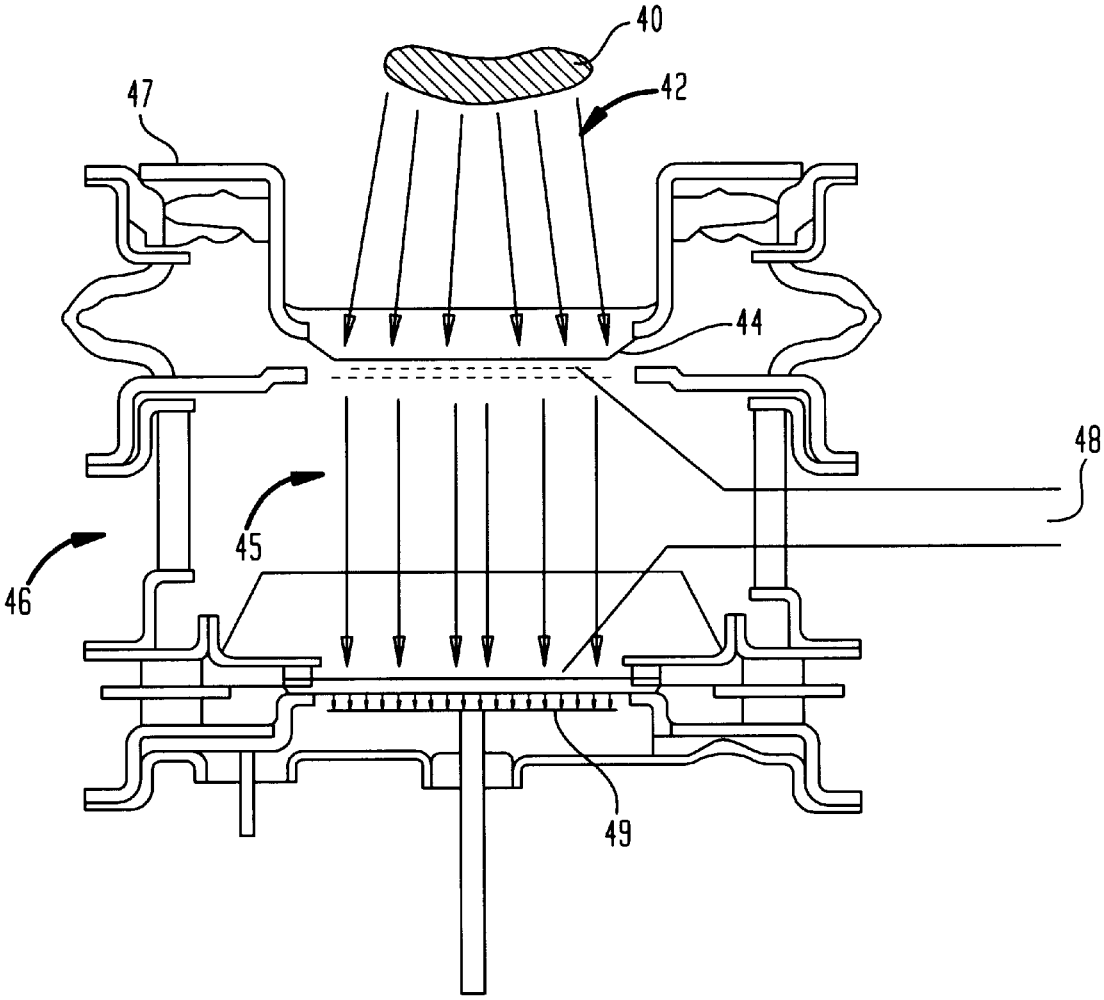
FIG. 4 (PRIOR ART)
FIG. 4 is a schematic of a gated MCP photomultiplier tube.

The structural similarity between prior art glass-MCP's and alumina films in accordance with the present invention is a primary advantage of the present invention (compare FIGS. 2 and 7). However, although the present invention and prior MCP's are somewhat similar in structure, MCP's according to the present invention have a number of advantages.

For example, while the channel shapes of a typical MCP (FIG. 2) and an MCP using anodized alumina in accordance with the present invention (FIG. 7) are similar in appearance, they are quite different in terms of scale. The typical channel diameter of a glass-based MCP is about 12 $\mu$m in diameter, while the typical diameter of an alumina-based MCP in accordance with the present invention is just 0.1 $\mu$m.

Another advantage of the present invention is that alumina is well adapted to the high voltage/high vacuum environment in which MCP's are placed. Aluminum oxide is one of the most common cernmic insulators used with high voltage and in high vacuum due in part to its low adsorption, high dielectric strength, low dielectric constant and low power factor. The resistance of a 0.1 mm thick alumina plate is about $10^9$ to $10^{10}$ $\Omega/cm^2$ (depending on the microstructure) and is sufficient for operation with very low dark currents. Alumina MCP's also have the advantage of being greater than 10 times thinner than the equivalent aspect ratio glass MCP thickness.

Another advantage of the present invention is that the areal density of the alumina channels of the present invention may exceed that of typical glass MCP matrices by orders of magnitude. For example, the number of channels in the present invention can reach from $10^7$ to $10^{10}/cm^2$, compared with at most about $10^6/cm^2$ for practical glass MCP. The higher areal density of the present invention offers superior spatial resolution of amplified electron images and lower dead time per area of plate over conventional micro-channel plates.

Further, alumina thin sheets or free-standing films in accordance with the present invention exhibit a highly anisotropic and uniform channel structure consisting of close-packed channels perpendicular to the film surface. The size and spatial distribution of the channels can be controlled simply by changing some of the parameters of the anodization process described above. Under controlled conditions, anodization of an aluminum surface results in a continuous amorphous film which contains straight, parallel holes or channels of very small cross-section, from 5 to 500 nm in diameter, with thickness' up to 0.5 mm.

The aspect ratio $\alpha$=L/d of the channels can also be adjusted up to approximately 2000:1 by the anodization process; 250:1 to 60:1 have been commonly achieved. The channel or pore area to plate area can be as high as 65% for holes with diameters between 5–300 nm. For example, FIG. 7 has an areal channel packing of approximately 65%. Accordingly, the present invention provides a method of economically manufacturing MCP's having small diameter channels packed closely together and thus less dead areas.

Another advantage of the alumina matrix is that it is a ceramic which can be baked out under high vacuum at temperatures of up to 1,600° C. This is about 1,200° to 1,300° hotter than the recommended operation of the glass channels (typical channel glasses soften well below 500° C.). Heating of the alumina at higher temperatures removes substantially more adsorbed gas and impurities than can be removed from glass channels.

The present invention also addresses prior problems relating to gain degradation and stability. Alumina ceramics are common in HV and vacuum electro-optics because of their stability under irradiation and the constancy of their resistivity. The use of highly pure alumina with elevated bake-out temperatures greatly reduces or even eliminates the impurity or poisoning molecule populations which limit the charge that can be drawn from glass-based MCP. Thus, significantly longer MCP lifetimes are possible. This represents a major advance in the range of applications of MCP in compact photomultipliers and photo-imaging amplification instruments.

The alumina-based MCP's of the present invention are expected to have greater thermal stability over existing glass MCP's because the secondary yield surface is fabricated from ceramic materials. Existing MCP's use Pb reduced from a glass to provide electrical conduction through the channels and as a secondary yield surface. At modest temperatures (400° C.), the reduced Pb in the channels may react with the remaining glass, changing the electrical properties of the reduced lead layer and altering the performance of the MCP. Alumina is a well known high temperature material capable of being heated to 1500° C. with no degradation. This means that the present invention can be used in applications where existing glass MCP cannot because of thermal considerations.

The thermal stability of the present invention also offers the advantage of nondestructive recovery from drawing excess current from the MCP. As described above the reduced Pb layer in present MCP's is susceptible to degradation due to thermal effects. Thermal degradation may be induced via Ohmic heating of the reduced Pb layer by current overdriving of the channels with a large input signal. Excess current through the present invention may induce some degradation of performance during the high current event, but since no physical changes to the plate will occur, the performance of the alumina MCP will return to its pre-vent condition after the high input current has passed.

The anodized alumina MCP fabrication process further offers the potential for making arbitrarily shaped MCP's. For example, the MCP can be shaped as a truncated shallow cone, a section of a sphere or many other shapes. The fabrication of shaped alumina MCP's is enabled because the aluminum precursor to the anodized alumina MCP can have an arbitrary shape. Potential shapes include films, foils or machined parts. The ability to easily make other shapes also allows a large range of electrode configurations which would permit the creation of a uniform electric field between a shaped cathode and the aluminum film anode.

In principle, the spatial resolution of an MCP used in an imaging application could be made as small as the distance between the channels, which with current techniques is as small as about 5–10 nm. The channels of the current invention are over 2 orders of magnitude smaller than typical existing glass MCP channels making extremely high resolution imaging possible.

If a technique of readout could be obtained, alumina MCP's would allow ultra-fine imaging. The channel spacing of the alumina plates gives over three orders of magnitude higher spatial resolution and would be far superior for position detection of charged particles or energetic photons than far lower resolution glass MCP's.

An important factor in the generation of amplified electron images in glass MCP's is the uniformity of the gain across the MCP. Although the gain per channel may not be as uniform in the present invention as with glass MCP's, other features of the present invention counters the lack of uniformity. For example, (a) the secondary emission gain does not depend critically on the incident angle for a reasonable range of angles, (b) the channels can easily be made so long that the channel gain fully saturates regardless of the surface condition—the aspect ratio $\alpha$ is typically much longer than $\alpha_M$~120, and so the gain saturates at $G_M$, (c) the major cause for channel-channel gain variations in glass MCP's is usually impurity variations and gain change with the total extracted charge in glass MCP's, which will be minimized in the present invention, and (d) for typical pixels of order about 10 $\mu$m×10 $\mu$m or larger, there will be thousands of channels in the alumina NCP, unlike a glass MCP with just one channel per pixel. The statistical average over thousands of channels per pixel will therefore minimize channel to channel variations in the pixel to pixel gain.

The detection efficiency for incident electrons is in part proportional to the amount of area taken by the channels. For a typical glass MCP, this is about 50%. However, it is possible to fabricate anodized aluminum channels with greater than 60% open hole area. It is, therefore, possible that the alumina films will have similar or better detection efficiency than typical glass MCP'S.

The area of an MCP in accordance with the present invention can be many centimeters on a side, depending only on the size of the original aluminum work piece. The size of glass MCP's is limited by the fabrication of the glass fiber loaded glass boules from which the MCPs are cut. While it is feasible for very large glass boules to be manufactured, the maintenance of uniform channel spacing within these boules is far more difficult than the production of a large array of channels via an anodization process for large area MCPs.

The transit time through the present invention should be an order of magnitude smaller than those of existing glass MCPs. This is because the thickness of the MCPs in the present invention are an order of magnitude smaller than that of glass MCPs. The improved transit times do not come at the expense of gain as the aspect ratio of the channels in the present invention can be the same as those in glass MCPs.

Alumina can be fashioned with extremely low self-radioactivity, unlike lead glass which either contain $^{40}K$, or $^{87}Rb$ beta emitters which are self-counting and are a major source of background in low-counting rate experiments. Thermionic emission will also be lower in alumina than in lead-glass materials by a factor of about 4.

Yet another advantage of the present invention is that the alumina is anticipated to be at least an order of magnitude more radiation-hard than glass MCP.

Although the invention herein has been described with reference to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. A method of manufacturing a microchannel plate comprising:

anodizing a plate of material to form channels which extend from a first side of said material to a second side of said material; and disposing first and second electrodes adjacent said first and second sides, respectively, wherein said step of anodizing comprises disposing said plate in an electrochemical cell containing an electrolyte, an anode for connection to said plate and a cathode disposed within said electrolyte and applying an electrical potential between said anode and said cathode so as to maintain said plate at a positive voltage with respect to said cathode, the method further comprising cleaning said plate before said step of anodizing by chemically etching the surface of said plate in a solution to remove excess oxide and dirt, rinsing said plate and vacuum baking said plate,wherein said solution is about 16:4:1:4 by volume of phosphoric acid, nitric acid, acetic acid and deionized water, respectively.

2. The method of claim 1 wherein said electrolyte comprises a 0.5 to 20 wt. percent aqueous solution containing an acid selected from the group consisting of phosphoric, sulfuric, oxalic, hydrofluoric, nitric, caustic soda and chromic acid and combinations thereof.

3. The method of claim 2 wherein said electrolyte comprises a 0.5 wt. percent solution of oxalic acid.

4. The method of claim 1 wherein said cathode is selected from the group consisting of lead, graphite, platinum and stainless steel and combinations thereof.

5. The method of claim 1 further comprising cleaning said plate before said step of anodizing by chemically etching the surface of said plate in a solution to remove excess oxide and dirt, rinsing said plate and vacuum baking said plate.

6. A method of manufacturing a microchannel plate comprising: anodizing a plate of material to form channels which extend from a first side of said material to a second side of said material; and disposing first and second electrodes adjacent said first and second sides, respectively, wherein said step of anodizing comprises disposing said plate in an electrochemical cell containing an electrolyte, an anode for connection to said plate and a cathode disposed within said electrolyte and applying an electrical potential between said anode and said cathode so as to maintain said plate at a positive voltage with respect to said cathode, the method further comprising electropolishing said plate before said step of anodizing, said step of electropolishing comprising placing said plate in an electrochemical cell in an about 4:1 solution of glacial acetic acid to about 60% perchloric acid containing a cathode and an anode, said cathode being a platinum wire mesh, and applying a potential of about 1 V across said cathode and anode for about 5 minutes.

7. A method of manufacturing a microchannel plate comprising:

anodizing a plate of material to form channels which extend from a first side of said material to a second side of said material;

disposing first and second electrodes adjacent said first and second sides, respectively; and widening said channels, wherein said plate remains immersed in water between said step of anodizing and said step of widening.

8. The method of claim 7 wherein said widening step comprises etching said channels in an about 0.5 to 80 wt percent phosphoric acid solution at a temperature between about 0 and 100° C.

9. The method of claim 7 wherein said solution is about 5 wt. percent phosphoric acid solution and said temperature is about 37° C.

10. The method of claim 7 wherein said step of disposing said electrodes comprises depositing said electrodes by oblique evaporation.

11. The method of claim 7 further comprising the steps of attaching said plate to a support frame, attaching said second electrode to said support frame, attaching a lead to said support frame, attaching a lead to said first electrode, and cleaning said plate.

12. The method of claim 7 further comprising the step of activating said material whereby the secondary emissivity and conductivity of the walls of said channels is increased.

13. A method of manufacturing a microchannel plate comprising:

(a) anodizing a plate of material to form channels which extend from a first side of said material to a second side of said material;

(b) disposing first and second electrodes adjacent said first and second sides, respectively; and (c) activating the microchannel plate by depositing on the walls of said channels a metal oxide selected from the group consisting of;

(i) $MgIn_2O_4$, $InGaO_3$, $Zn_2In_2O_5$, $MnO_2$, $Cr_2O_3$, and Indium Tin Oxide;

(ii) combinations of any of the oxides set forth in (i) and;

(iii) combinations of any of the oxides set forth in (i) with $SnO_2$.

14. The method of claim 13 wherein said step of depositing a metal oxide on said channel walls includes Metal-Organic Deposition (MOD).

15. The method of claim 13 wherein said step of depositing a metal oxide on said channel walls includes Chemical Vapor Deposition (CVD).

16. A microchannel plate manufactured in accordance with the method of claim 13.

* * * * *

UNITED STATES PATENT AND TRADEMARK OFFICE

CERTIFICATE OF CORRECTION

PATENT NO. : 6,045,677

DATED : April 4, 2000

INVENTOR(S) : Beetz, Jr., et al.

It is certified that error appears in the above-indentified patent and that said Letters Patent is hereby corrected as shown below:

Title page, under "Attorney, Agent or Firm" "Menlik should read --Mentlik--.

Col. 1, line 41, "a" should read --$\alpha$--.

Col. 1, line 49, "tin" should read --thin--.

Col. 12, line 3, "pre-vent" should read --pre-event--.

Col. 12, line 38, " $\alpha_M \sim 120$" should read -- $\alpha_M \sim 120$--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*